US009195216B2

(12) United States Patent
Kaelin et al.

(10) Patent No.: US 9,195,216 B2
(45) Date of Patent: Nov. 24, 2015

(54) TIMEPIECE MOVEMENT HAVING A BARREL WITH REDUCED CORE DIAMETER

(75) Inventors: Laurent Kaelin, Sonvilier (CH); Baptist Wyssbrod, Nidau (CH); Arthur Queval, Lutry (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 14/241,337

(22) PCT Filed: Sep. 13, 2012

(86) PCT No.: PCT/EP2012/067910

§ 371 (c)(1),
(2), (4) Date: Feb. 26, 2014

(87) PCT Pub. No.: WO2013/037868

PCT Pub. Date: Mar. 21, 2013

(65) Prior Publication Data

US 2014/0376338 A1 Dec. 25, 2014

(30) Foreign Application Priority Data

Sep. 15, 2011 (EP) ..... 11181351

(51) Int. Cl.
*G04B 1/16* (2006.01)
*G04B 1/14* (2006.01)
(Continued)

(52) U.S. Cl.
CPC .. *G04B 1/16* (2013.01); *G04B 1/14* (2013.01); *G04B 1/145* (2013.01); *G04B 1/18* (2013.01); *G04B 33/14* (2013.01); *G04B 35/00* (2013.01)

(58) Field of Classification Search
CPC ..... G04B 1/10; G04B 1/14; G04B 1/16; G04B 1/18; G04B 33/14; G04B 35/00; G04B 1/145
See application file for complete search history.

(56) References Cited

U.S. PATENT DOCUMENTS 182,629 A 9/1876 Barclay
996,499 A 6/1911 Marshall
(Continued)

FOREIGN PATENT DOCUMENTS

CH 318898 1/1957
EP 1 542 098 A2 B1 6/2005
(Continued)

OTHER PUBLICATIONS

International Search Report issued Feb. 4, 2013, in PCT/EP12/067910 filed Sep. 13, 2012.

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

A timepiece movement includes a plate and a bridge carrying a barrel, which includes a barrel mainspring between a drum and a receiving surface of a steel or stainless steel core and a cover fixed to the drum. The spring is made of a multiphase, cobalt-nickel-chromium based alloy, having a Young's modulus of between 200 and 240 GPa and a shear modulus of between 80 and 100 GPa, and having a width to thickness ratio of between 3 and 23, and a maximum radius of the steel or stainless steel core relative to a pivot axis is less than nine times a maximum thickness of the spring. The movement includes a shake limiting mechanism including a shim-washer independent of the core and guided by a shoulder of the core.

19 Claims, 12 Drawing Sheets

(51) Int. Cl.

| | |
|---|---|
| ***G04B 1/18*** | (2006.01) |
| ***G04B 33/14*** | (2006.01) |
| ***G04B 35/00*** | (2006.01) |

(56) References Cited

U.S. PATENT DOCUMENTS

| | | | | |
|---|---|---|---|---|
| 1,033,020 | A | 7/1912 | Kern | |
| 3,121,990 | A * | 2/1964 | Laviolette | 368/127 |
| 4,077,201 | A * | 3/1978 | Perrot | 368/324 |
| 2005/0249045 | A1 | 11/2005 | Schneider | |
| 2010/0149928 | A1 * | 6/2010 | Reynard | 368/206 |
| 2013/0044574 | A1 * | 2/2013 | Kaelin et al. | 368/318 |
| 2013/0133788 | A1 * | 5/2013 | Aljerf et al. | 148/548 |
| 2013/0223194 | A1 * | 8/2013 | Cattin et al. | 368/143 |

FOREIGN PATENT DOCUMENTS

| | | | |
|---|---|---|---|
| FR | 1 473 744 | | 3/1967 |
| GB | 647783 | | 12/1950 |
| GB | 647819 | * | 12/1950 |
| WO | WO 2012/010941 A1 | | 1/2012 |

* cited by examiner

Fig. 1
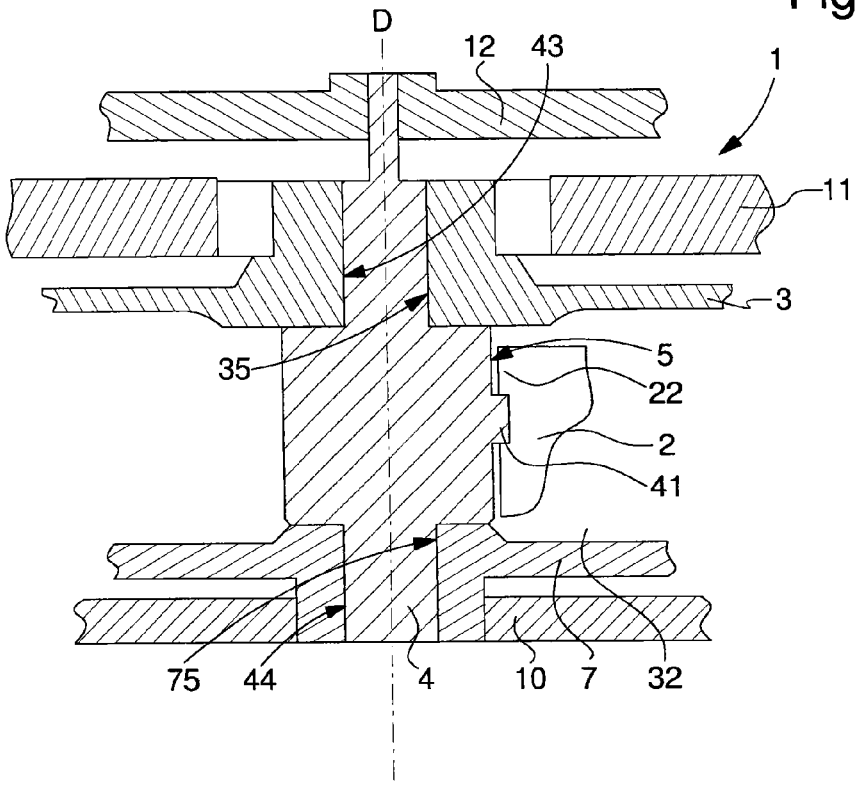
Fig. 2
Fig. 3
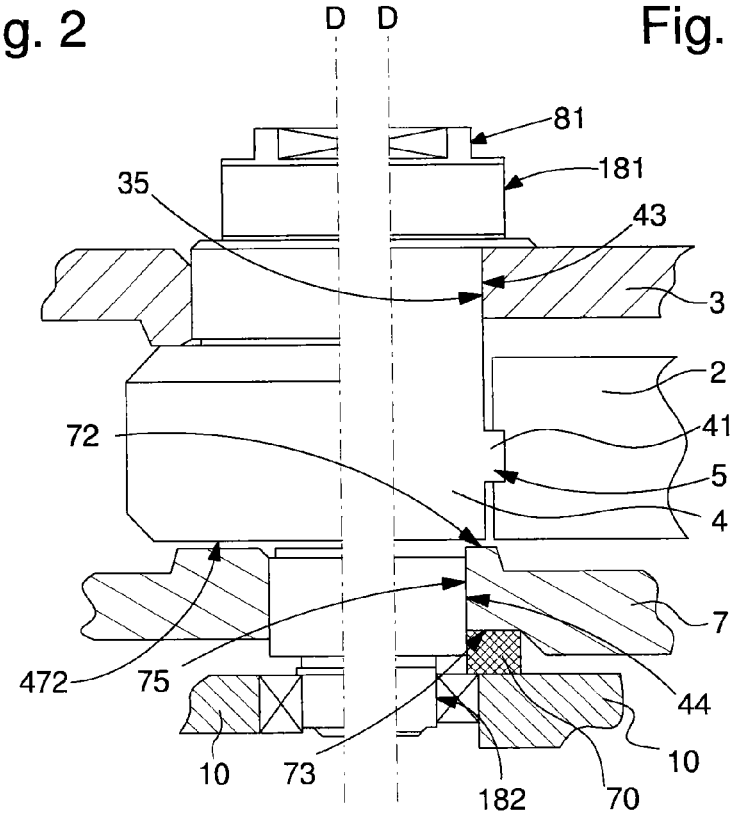

Fig. 6
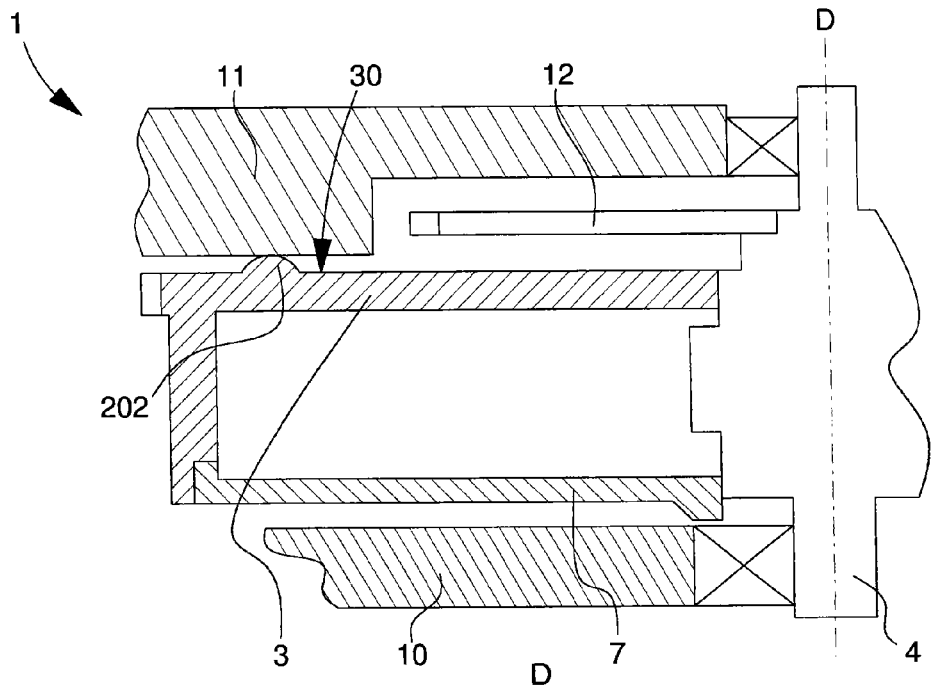
Fig. 7
Fig. 8
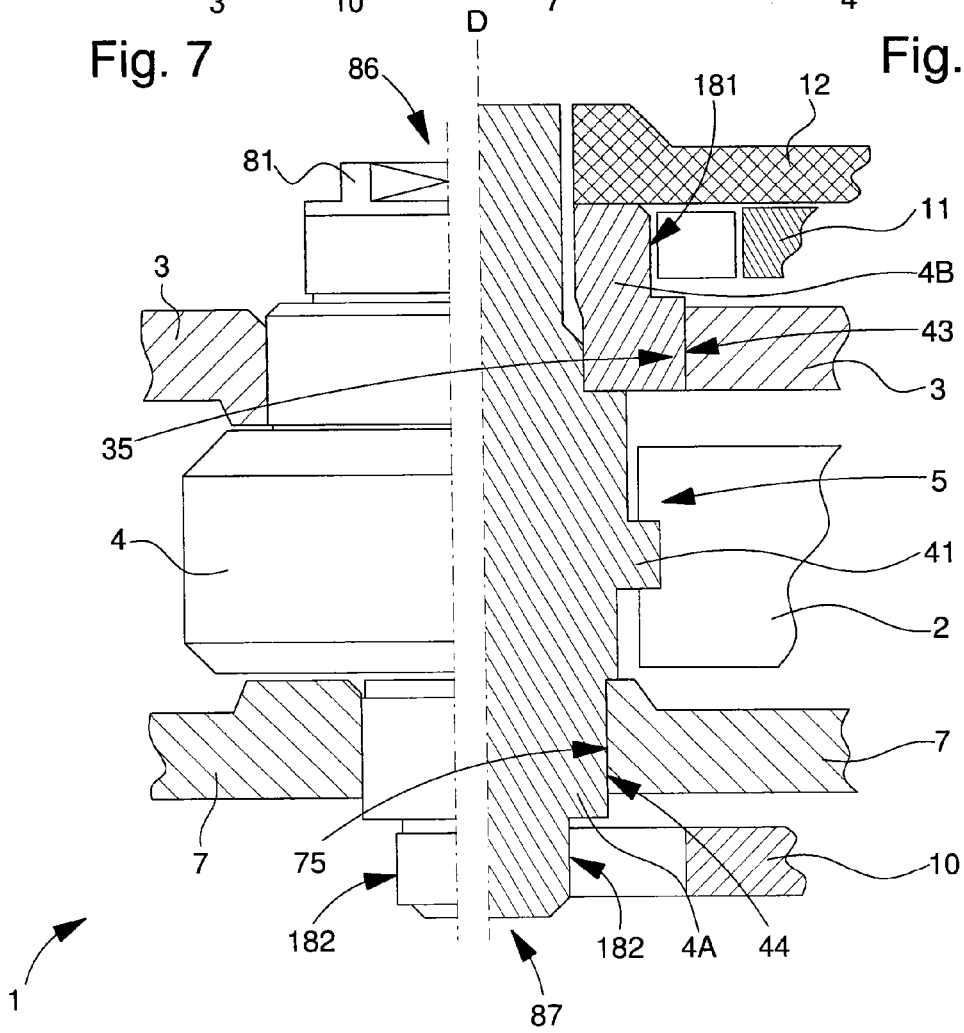

TIMEPIECE MOVEMENT HAVING A BARREL WITH REDUCED CORE DIAMETER

CROSS-REFERENCE TO RELATED APPLICATIONS

This is a National Phase Application in the United States of International Patent Application PCT/EP 2012/067910 filed Sep. 13, 2012, which claims priority on European Patent Application No 11181351.5 of Sep. 15, 2011, the entire contents of each of which are incorporated herein by reference.

FIELD OF THE INVENTION

The invention concerns a timepiece movement including at least one plate at a fixed distance from a bridge jointly carrying a timepiece barrel assembly, which barrel assembly includes at least one barrel mainspring mounted between, at a first end, a barrel drum arranged beside said bridge, and at a second end, a receiving surface of a barrel core rotating integrally with a ratchet and coaxial to said drum about a common pivot axis, said barrel assembly including on said plate side a cover fixed to said drum, said cover and said drum together forming a chamber confining said spring.

The invention also concerns a timepiece including at least one such timepiece movement.

The invention concerns the field of horology, and more specifically the field of energy storage barrels, for powering a movement, a striking work, or another timepiece function.

BACKGROUND OF THE INVENTION

In order to increase the power reserve, by increasing the number of turns of a mainspring, one solution consists in decreasing the diameter of the barrel arbour and of the associated core, so as to increase the space available for the spring inside the drum.

The ratio of the core radius to the spring thickness is usually comprised between 10 and 20 and the invention proposes to reduce this ratio to below 10, and preferably to within a range of between 5 and 10.

The sizing must not be too small; there is a risk of breakage if the core diameter is too small.

In the conventional barrel architecture, a ratchet is axially mounted on a barrel arbour or on a core, via a square, with the ratchet usually being secured by an axial screw. The dimension of this screw and that of the square thus define the minimum diameter of a pivot shoulder. A step portion joined to this pivot shoulder limits the endshake of the arbour or of the core relative to a bottom plate or to a bridge carrying a jewel or similar element.

An even larger diameter than that of the step portion is required for a shoulder for guiding the pivoting of the drum on the arbour or on the core, combined with a step portion limiting the endshake of the drum. The dimension chain required to observe minimal sections of material results in substantial dimensions, which are difficult to reduce. In particular, it is not sufficient merely to reduce all of the dimensions, since the cross-sections of material are then insufficient to ensure fatigue resistance.

U.S. Pat. No. 996,499 A in the name of MARSHALL discloses a barrel wherein the ratchet is integral with a single-piece cover which includes the hook for hooking the outer coil of the balance spring. The cover is guided by a shoulder in the plate, and includes a bore in which the end of the barrel arbour is guided. The barrel arbour has a main cylindrical shoulder, which guides the drum via two bearings. This shoulder is limited by a stop shoulder, which holds the drum at a distance from the bridge, in which one end of the barrel arbour rotates. Whereas the back cover includes a step portion arranged to limit its travel relative to the plate. The mainspring is thus not mounted between the arbour and drum, but between the drum and the cover.

CH Patent Application No 318898A in the name of JUNGHANS discloses a barrel which includes a drum having a pipe on which the core pivots; the core is connected, via a square, to the barrel arbour pivoting between the bridge and plate, and is clamped to the ratchet. On the opposite side to the ratchet, the arbour carries a toothed wheel cooperating with the self winding mechanism. A fillet on a bridge limits the clearance of this toothed wheel.

U.S. Pat. No. 1,033,020A in the name of KERN discloses a barrel with a cover for closing the drum fixed to the drum by a bayonet and pin, the cover carrying the toothing.

EP Patent Application No 1542098A2 in the name of LANGE concerns a particular configuration wherein the drum is guided by its periphery in a bore in the bridge, and wherein the drum includes a projecting annular surface, called a support area, which extends radially beyond the guide bore in the drum so as to provide a support, or stop member, for the drum on the bridge.

SUMMARY OF THE INVENTION

As a result of these physical limitations on the dimensioning of the various components, it is necessary to envisage different barrel architectures from the conventional architecture that has just been described.

The invention takes account of several solutions to arrive at this decrease in core diameter.

A significant constraint is ensuring that the assembly can be dismantled, if necessary, to change the mainspring.

The invention therefore concerns a timepiece movement including at least one plate at a fixed distance from a bridge jointly carrying a timepiece barrel assembly, which barrel assembly includes at least one barrel mainspring mounted between, at a first end, a barrel drum arranged beside said bridge, and at a second end, a receiving surface of a barrel core rotating integrally with a ratchet and coaxial to said drum about a common pivot axis, said barrel assembly including on said plate side a cover fixed to said drum, said cover and said drum together forming a chamber confining said spring, characterized in that said spring is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shear modulus of between 80 and 100 GPa, and having a width to thickness ratio of between 9 and 21, and in that the maximum thickness of said steel or stainless steel core relative to said pivot axis is less than nine times the maximum thickness of said spring, and further characterized in that said movement includes a shake limiting means including at least one shim-washer, which is independent of said core and guided by a shoulder of said core and inserted between, on the one hand, said plate or said bridge respectively, and on the other hand said cover or said drum respectively.

According to a feature of the invention, said drum pivots in said bridge or in a guide member carried by said bridge, and includes an axial support shoulder arranged to cooperate to limit the end of travel of said drum with a complementary stop surface of said bridge or said guide member, and said cover pivots in said plate or in a guide member carried by said plate, and includes an axial support shoulder arranged to cooperate to limit the end of travel of said cover with a complementary stop surface of said plate or said guide member; and said core includes a first shoulder pivoting in a bore in said drum, and a second shoulder pivoting in a bore in said cover, and the relative endshake between said core and said drum is limited by a first stop surface of said core and a first complementary internal stop surface of said drum, and the relative endshake between said core and said cover is limited by a second stop surface of said core and a second complementary internal surface of said cover.

According to a feature of the invention, said barrel assembly includes a means of limiting the endshake between said barrel assembly and at least said plate or said bridge.

The invention further concerns a timepiece including at least one timepiece movement of this type with a barrel assembly of this type for energy storage with one input formed either by a ratchet mounted for integral rotation with said core, or by a drum toothing mounted for integral rotation with said drum, and an output formed respectively either by a drum toothing mounted for integral rotation with said drum, or by a ratchet mounted for integral rotation with said core.

BRIEF DESCRIPTION OF THE DRAWINGS

Other features and advantages of the invention will appear more clearly upon reading the following detailed description, with reference to the annexed drawings, in which:

FIG. 1 shows a schematic cross-section of a timepiece barrel according to a variant of the invention in a plane passing through the pivot axis thereof.

FIG. 2 shows a schematic cross-section of a barrel with a conventional core in a plane passing through the pivot axis, and FIG. 3 illustrates the transformation of this barrel assembly and core according to a variant of the invention with a shim-washer.

FIGS. 4 to 6 show schematic partial and cross-sectional views, in a plane passing through the pivot axis, of a barrel according to variants of the invention, with support members in the form of fillets, respectively between a bridge and a ratchet in FIG. 4, and between, on the one hand, a bridge carrying a fillet and the drum, and on the other hand a plate and the barrel cover, said cover carrying a fillet, in FIG. 5, and between the drum and a bridge with a fillet on the drum in FIG. 6.

FIG. 7 shows a schematic cross-section of a barrel with a conventional core, in a plane passing through the pivot axis, and FIG. 8 illustrates the transformation of the barrel assembly and of the core in a variant of the invention, with a core in two stepped parts.

FIG. 10 shows a single-piece core guided in two jewels of the plate and of a bridge, said core carrying the drum and cover, the drum having a fillet arranged on an external face thereof for cooperating in abutment with the jewel of the top bridge, FIG. 11 is similar to FIG. 10 and includes an adjustment washer driven onto the core and arranged to be supported on a face of the cover.

FIG. 12 has a single-piece core guided in two jewels of the plate and of a bridge, said core carrying the drum and cover, the drum having a fillet arranged on an external face thereof for cooperating in abutment with the jewel of the top bridge, and the cover having a similar fillet for cooperating with the jewel of the plate, the spring including a first enlarged coil.

FIG. 13 has a core in two parts, one part called the barrel arbour is guided in a jewel of a bridge and carries the drum, and the other called the core is guided in a jewel of a plate and carries the cover, the cover having a fillet arranged on the external surface thereof for cooperating in abutment with the jewel of the plate, the spring including an enlarged coil, which is not the first coil.

FIG. 14 is similar to FIG. 12, having a single-piece core guided in two jewels of the plate and of a bridge, said core carrying the drum and cover, the drum having a fillet on the external face thereof for cooperating in abutment with a jewel of the top bridge, and the cover having a similar fillet for cooperating with the jewel of the plate, the drum and the cover being clamped onto step portions of the core, and the ratchet being screwed onto the core which is threaded.

FIG. 15 shows a single-piece core guided in two jewels of the plate and of a bridge, said core carrying the drum and cover and including a collar arranged for cooperating in abutment with an inner face of the drum.

FIG. 16 is similar to FIG. 14, having a single-piece core carrying the drum and cover, which are each guided in a jewel of the plate and of a bridge, the drum having a fillet on the external face thereof for cooperating in abutment with a jewel of the top bridge, and the cover having a similar fillet for cooperating with the jewel of the plate, the drum and the cover being clamped onto step portions of the core, and the ratchet being screwed onto the core which is threaded.

DETAILED DESCRIPTION OF PREFERRED EMBODIMENTS

Figure 4:
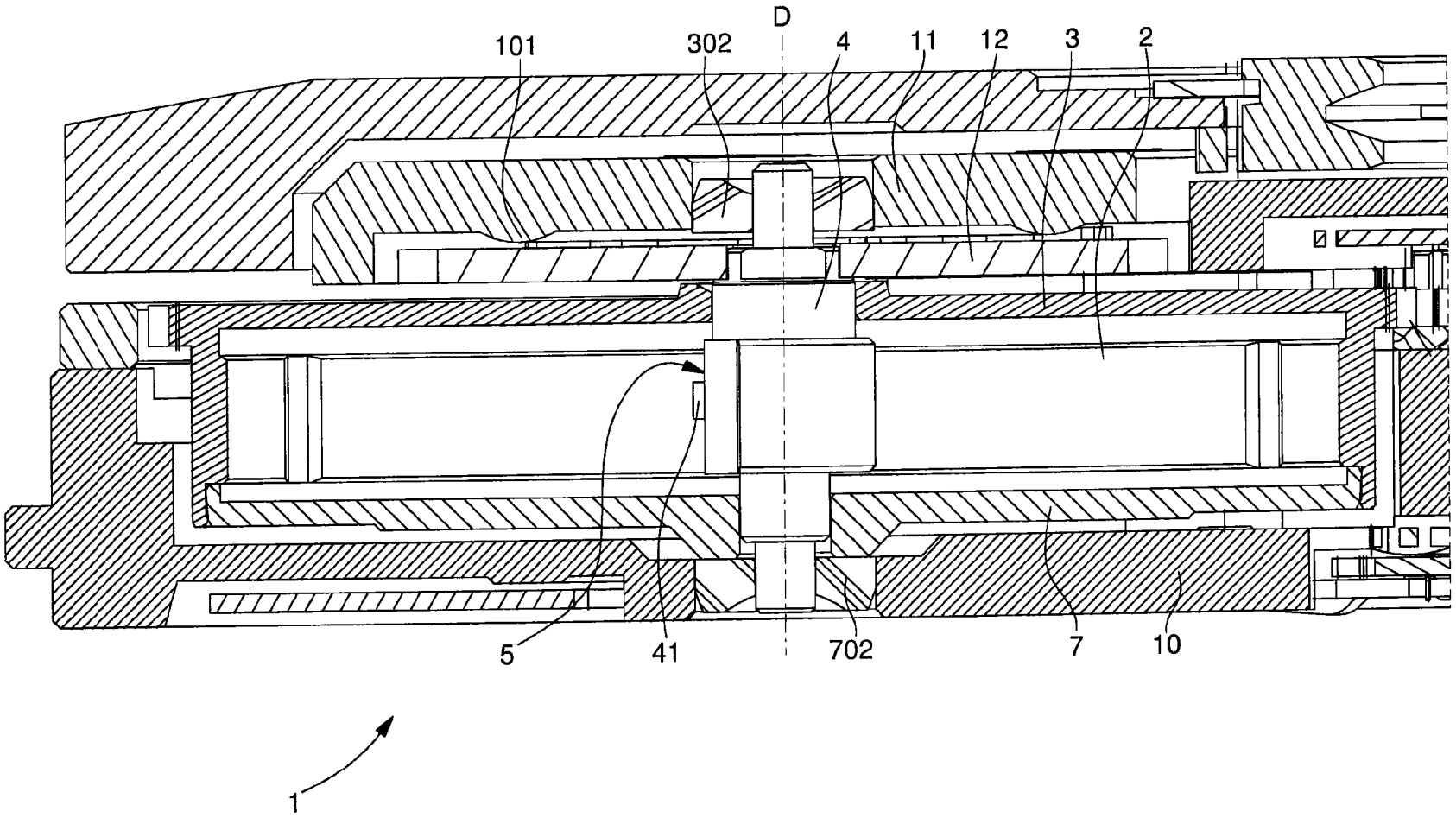

The invention concerns the field of horology, and more specifically the field of energy storage barrels, for powering a movement, a striking work, or another timepiece function.

In a preferred and non-limiting embodiment, the invention concerns a timepiece movement 100 including at least one plate 10 at a fixed distance from a bridge 11 jointly carrying a timepiece barrel assembly 1.

This barrel assembly 1 includes at least one barrel spring 2 mounted between, at a first end 21, a barrel drum 3 arranged beside the bridge 11, and at a second end 22, a receiving surface 5 comprised in a barrel core 4 rotating integrally with a ratchet 12 and coaxial to drum 3 about a pivot axis D. Barrel assembly 1 includes on plate 10 side a cover 7 fixed to drum 3, said cover 7 and said drum 3 together forming a chamber 32 confining spring 2.

Different cumulative variants are illustrated in the Figures. According to the invention, spring 2 is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shear modulus of between 80 and 100 GPa. This spring 2 has a width to thickness ratio comprised between 3 and 23, and more particularly between 9 and 21.

The maximum radius of steel or stainless steel core 4 relative to pivot axis D is less than nine times the maximum thickness of spring 2. In particular, the illustrated embodiments make it possible to obtain a ratio of close to five.

Further, movement 100 comprises a shake limiting means. In the FIG. 3 variant, this limiting means includes a shim means or travel limiting means including a shim-washer 70 inserted between, on the one hand a plate 10 or a bridge 11, and on the other hand drum 3 or a cover 7 fixed to drum 3 to form therewith a chamber 32 confining spring 2. This shim-washer 70 is independent of core 4 and guided by a shoulder 44 comprised in said core 4 and inserted between, on the one hand plate 10 or bridge 11 respectively, and on the other hand cover 7 or drum 3 respectively.

In a variant visible in FIG. 3, this at least one shim-washer 70 is preferably guided by a shoulder 44 of core 4, and more specifically is driven onto said shoulder 44.

In another variant, the shake limiting means includes a first shim-washer 70 inserted between bridge 11 and drum 3 and a second shim-washer 70 inserted between plate 10 and cover 7.

In another variant, shim-washer 70 is independent, on the one hand from a barrel arbour 18 carrying core 4 or merged therewith, and on the other hand from cover 7, and is inserted between plate 10 and cover 7.

In a particular variant, core 4 is directly pivoted in plate 10 and bridge 11.

Figure 16:
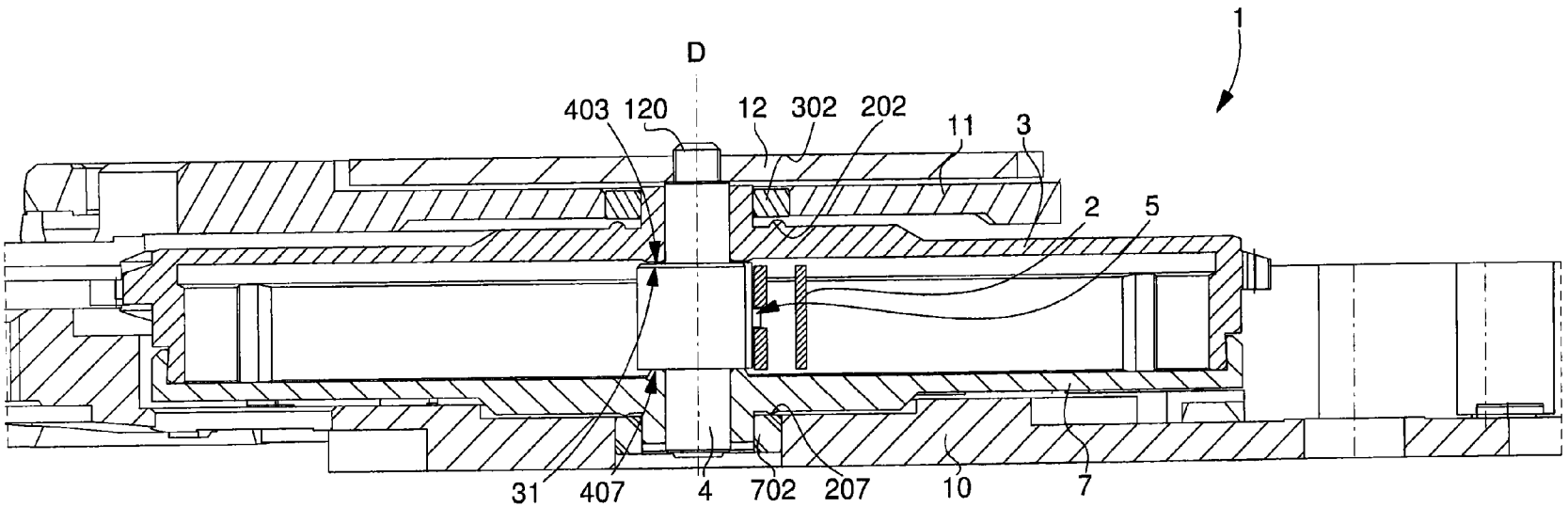

In another variant, visible in FIGS. 1 and 16, core 4 is indirectly pivoted in plate 10 and bridge 11, via cover 7 and drum 3 respectively.

In the variant illustrated in FIG. 8, core 4 has two coaxial parts 4A, 4B, of which one part 4B is pivoted directly in bridge 11 and has a guide shoulder 43 for a bore 35 of drum 3, and the other part 4A is directly pivoted in plate 10 and carries a hook 41 for hooking spring 2.

In the same FIG. 8 variant, drum 3 pivots in bridge 11 or in a guide member 403 carried by bridge 11 and includes an axial support shoulder 39 arranged to cooperate to limit the end of travel of drum 3 with a complementary stop surface 119 of bridge 11 or guide member 403. Cover 7 pivots in plate 10 or in a guide member 108 carried by plate 10, and includes an axial support shoulder 79 arranged to cooperate to limit the end of travel of cover 7 with a complementary stop surface 109 of plate 10 or guide member 108.

Core 4 includes a first shoulder 43 pivoting in a bore 35 of drum 3 and a second shoulder 44 pivoting in a bore 75 of cover 7. The relative axial clearance between core 4 and drum 3 is limited by a first stop surface 403 of core 4 and a first complementary inner stop surface 31 of drum 3. The relative axial clearance between core 4 and cover 7 is limited by a second stop surface 407 of core 4 and a second complementary inner stop surface 71 of cover 7.

Advantageously, as visible in FIGS. 1 and 16, this axial support shoulder 39 of drum 3 and/or axial support shoulder 79 of cover 7 is formed by a fillet 202, 207 to reduce surface contact. The fillet 202, 207 is supported on a guide member 403, 108 carried by bridge 11 or plate 10.

Advantageously, as seen particularly in FIG. 8, movement 100 includes a means 6 for limiting the endshake between barrel assembly 1 and at least plate 10 or bridge 11.

In a variant, this limiting means includes a means of guiding the pivoting of drum 3 and of cover 7 directly in plate 10 and/or in bridge 11.

This limiting means advantageously includes a shim means or means of limiting the travel of drum 3 and/or cover 7 relative to plate 10 or to bridge 11.

Figure 5:
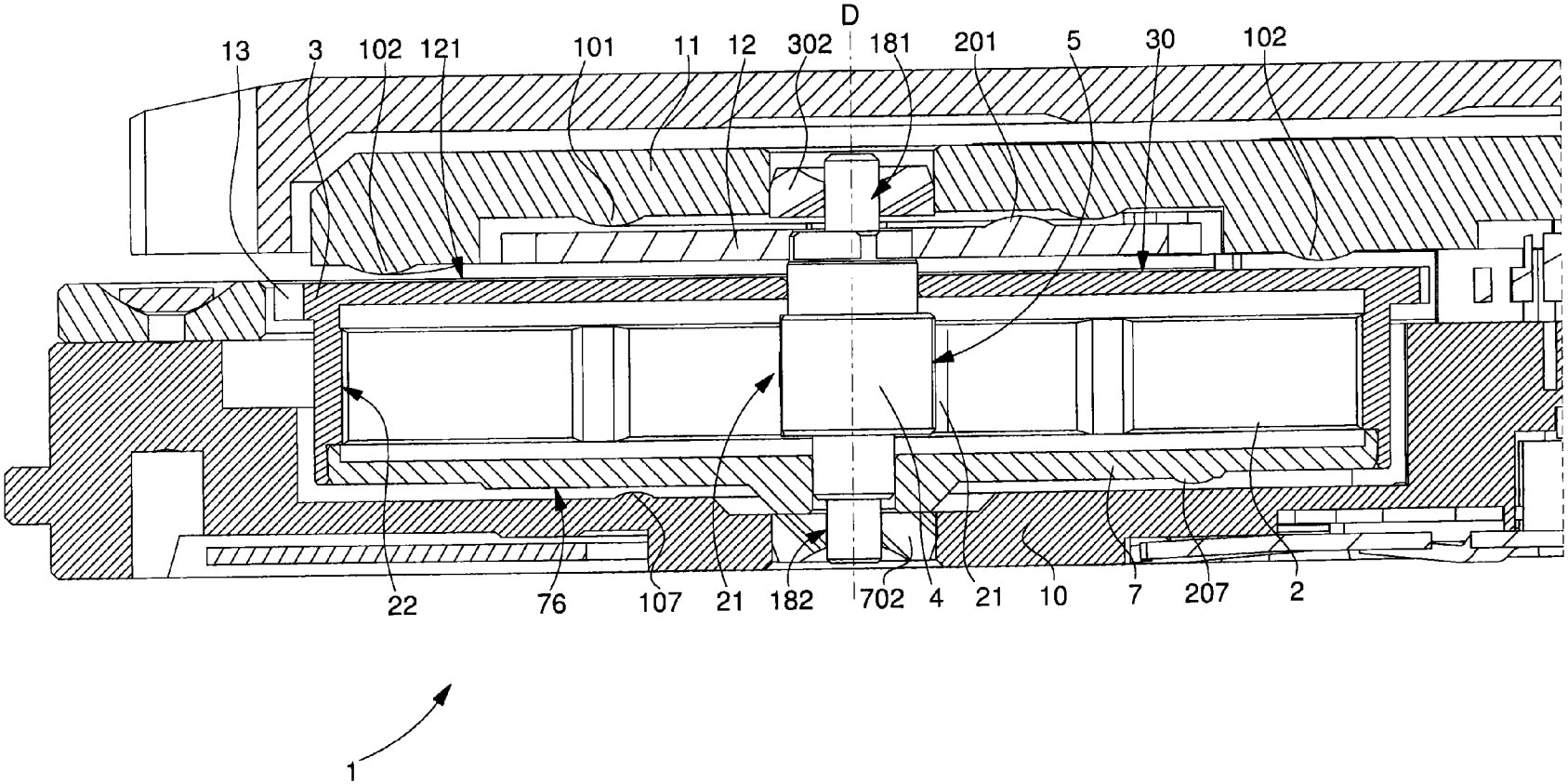
Figure 9:
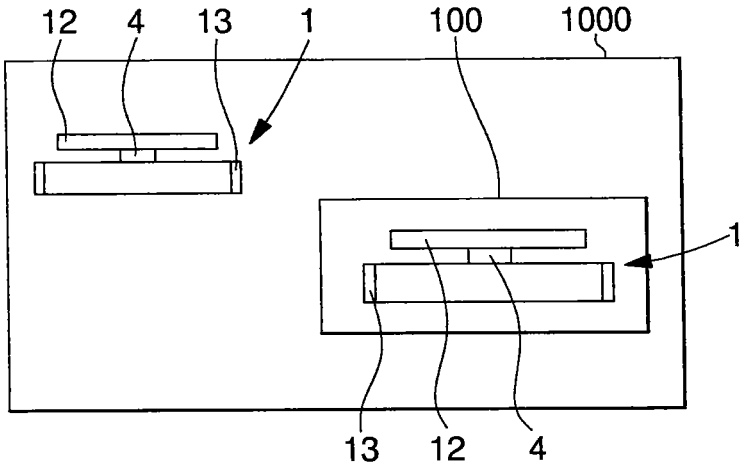
FIG. 9 shows block diagrams of a timepiece including a movement and a barrel assembly according to the invention.

In the variant illustrated in FIG. 6, the limiting means includes at least one lip 202, which protrudes from an external surface 30 of drum 3 opposite plate 10 or bridge 11 and/or, as seen in FIG. 5, at least one lip 102 protruding from an external surface of plate 10 or of bridge 11 and facing an external surface 30 of drum 3.

In a variant illustrated in FIG. 5, the limiting means includes at least one lip 207 protruding from an external surface 76 of cover 7, opposite plate 10 or bridge 11 and/or at least one lip 107 protruding from an external surface of plate 10 or of bridge 11 and facing an external surface 76 of cover 7.

The limiting means is advantageously supplemented, as seen in the FIG. 5 variant, by at least one lip 201 protruding from an external surface 121 of ratchet 12 carried by core 4 opposite plate 10 or bridge 11 and/or by at least one lip 101 protruding from an external surface of plate 10 or of bridge 11 and facing an external surface 121 of ratchet 12.

In a particular embodiment, receiving surface 5 is a surface of revolution relative to pivot axis D.

In a variant embodiment, spring 2 is fixed by friction to core 4.

In an advantageous preferred embodiment, spring 2 forms, with core 4, a single-piece, welded or soldered or similar spring-core sub-assembly. These two variants of fixing by friction or welding or similar mean that the hook hooking the spring can be omitted.

The invention takes account of several solutions to arrive at this decrease in core diameter, which makes it possible to increase the energy stored in the barrel.

The various means proposed by the invention can be combined with each other, to obtain an optimum result according to the space available, the position of the ratchet, the presence or absence of a cover for closing the barrel, although this function can also be performed by the ratchet.

A first solution consists in providing for the shake between the drum and cover by the mainspring, by transferring the shake adjustment function to the spring, in particular by fitting the spring with projecting areas, such as lugs, wider laminated areas, adding a flange, or similar. It is then possible to do without the shoulders supporting the drum and the cover on the barrel arbour or on the core.

A second solution consists in forming a core in several parts, particularly in two or three parts. This solution notably makes it possible to form a core of smaller diameter than the pivoting diameter of the drum. Advantageously, the core is inserted through the bore in the drum. An arbour or a core in two or more parts facilitates the machining of the hook for hooking the mainspring eye.

The core may include, for driving the ratchet, a conventional square or a screw thread. Or, in a non-limiting manner, in a second variant, the core may also include one or more diameter adjustment washers or rings for guiding the core inside the plate and bridge.

Another solution consists in driving a washer onto the core to adjust the drum-cover shake. This washer is mounted so as to prevent any disassembly of a bridge, when intervention is required on the barrel.

Yet another solution consists in providing for the pivoting of the drum and/or the cover in the bridges, instead of pivoting occurring on the barrel arbour or the core. Advantageously, both the drum and the cover are pivoted in a plate and a bridge.

The different variants proposed by the invention ensure ease of machining, assembly and disassembly, and control of the endshakes between the various components and relative to the bridges.

Two types of endshake require consideration:

the endshake of the barrel "alone" on the one hand, the endshake of the barrel with the ébauche or ébauches, hereafter referred to for the sake of simplicity and in a non-limiting manner as a plate and bridge, on the other hand.

These endshakes are added to each other and the design must therefore take account of both.

The invention is from the outset concerned with seeking to reduce the core diameter as much as possible. As such, the invention aims to offer new solutions for taking up one shake or the other or both.

The invention is therefore devised to implement alternative solutions for taking up the shake of the barrel "alone":

- a contact between the barrel drum and/or the barrel cover on the one hand, and on the other hand a shoulder of the core, of the barrel arbour depending on the architecture of the core;
- placing in contact, with one or more surfaces, the mainspring on the one hand, with the barrel drum and/or the barrel cover on the other hand.

In this embodiment with contact between the spring and one or more internal surfaces of the chamber in which the spring is confined (whether the chamber is formed by a drum and a cover, or by a drum and a ratchet, or by a drum and a bridge), several variants are possible:

- the first inner coil of the spring, in contact with the receiving surface of the core, is higher than the other coils;
- another coil, sufficiently removed from the core not to cooperate with a shoulder of the core, but to cooperate directly with an inner surface of the drum, or of the cover, or similar, is higher than the other coils;
- some coils are higher than the other coils;
- at least one coil of greater height than the others is added to the spring;
- or, to ensure a shake limiting contact between the spring and an inner wall of the chamber, the drum and/or the cover includes or include one or more protuberances, lips, fillets or similar, on an inner face facing the spring. A "fillet" here means a surface, preferably a surface of revolution, projecting from a surface, for cooperating in abutment on a nearby surface of another component to hold the surfaces at a distance from each other when play take-up in the mechanism, under the effect of gravity or an acceleration due to a movement by the user, pushes the components towards each other.

With regard to taking up the shake of the barrel completed by the ébauche in which the barrel assembly is incorporated, the invention offers several variants:

- a contact between on the one hand a shoulder of the core or of the barrel arbour (depending on the design of the core), and on the other hand a jewel or a guide element comprised in a plate or bridge of the ébauche;
- a contact between, on the one hand the barrel drum and/or the barrel cover, and on the other hand a jewel or a similar guide means, driven into a plate or a bridge, via one or more protuberances, lips, fillets or similar, arranged on a face of the drum and/or of the cover;
- a contact between, on the one hand the barrel drum and/or the barrel cover, and on the other hand a jewel or a similar guide means, driven into a plate or a bridge, via one or more protuberances, lips, fillets or similar, arranged on a face of the plate and/or of the bridge.

The Figures illustrate certain particular embodiments from among the multiple possible combinations of the invention.

According to the invention, movement 100 includes a means 6 of limiting the endshake between barrel assembly 1 and at least one plate 10 or bridge 11 carrying barrel assembly 1.

The limiting means is:

- either formed by a shim means or means of limiting the travel, relative to plate 10 or bridge 11, of drum 3 and/or of a cover 7 fixed to drum 3 to form therewith a chamber 32 confining spring 2,
- or formed by a means of guiding the pivoting, directly in a plate 10 and/or in a bridge 11, of drum 3 and/or of a cover 7 fixed to drum 3 to form therewith a chamber 32 confining spring 2,
- or formed by a combination of the shim means or travel limiting means and the pivotal guide means, in the direction of pivot axis D, to limit the shake between barrel assembly 1 and the at least one plate 10 or bridge 11.

FIGS. 4 to 6 illustrate supports in the form of fillets, respectively between a bridge 11 and a ratchet 12 in FIG. 4, and between on the one hand a bridge 11 carrying a fillet 102 and drum 3, and on the other hand between a plate 10 and cover 7 of barrel 1. This cover 7 carries a fillet 207 in FIG. 5, which shows a plate 10 and a bridge 11 each carrying a fillet, respectively 107 and 102, respectively cooperating with cover 7 and drum 3.

The support fillet is formed between drum 3 and a bridge 11 with a fillet 202 on drum 3 in FIG. 6.

FIG. 8 illustrates a core 4 in two stepped parts 4A and 4B, part 4B including a guide shoulder for a bore 35 of drum 3. The main part 4A is guided in a jewel driven into plate 100 on a shoulder 182 at the bottom end 87 thereof, cover 7 being guided on a shoulder 44 of flange 4A which cooperates with a bore 75 in cover 7. Part 4B is guided by a shoulder 181 in a jewel driven into bridge 11 towards the top end 86 thereof. This Figure illustrates the conventional hooking of spring 2 onto a hook 41.

Figure 10:
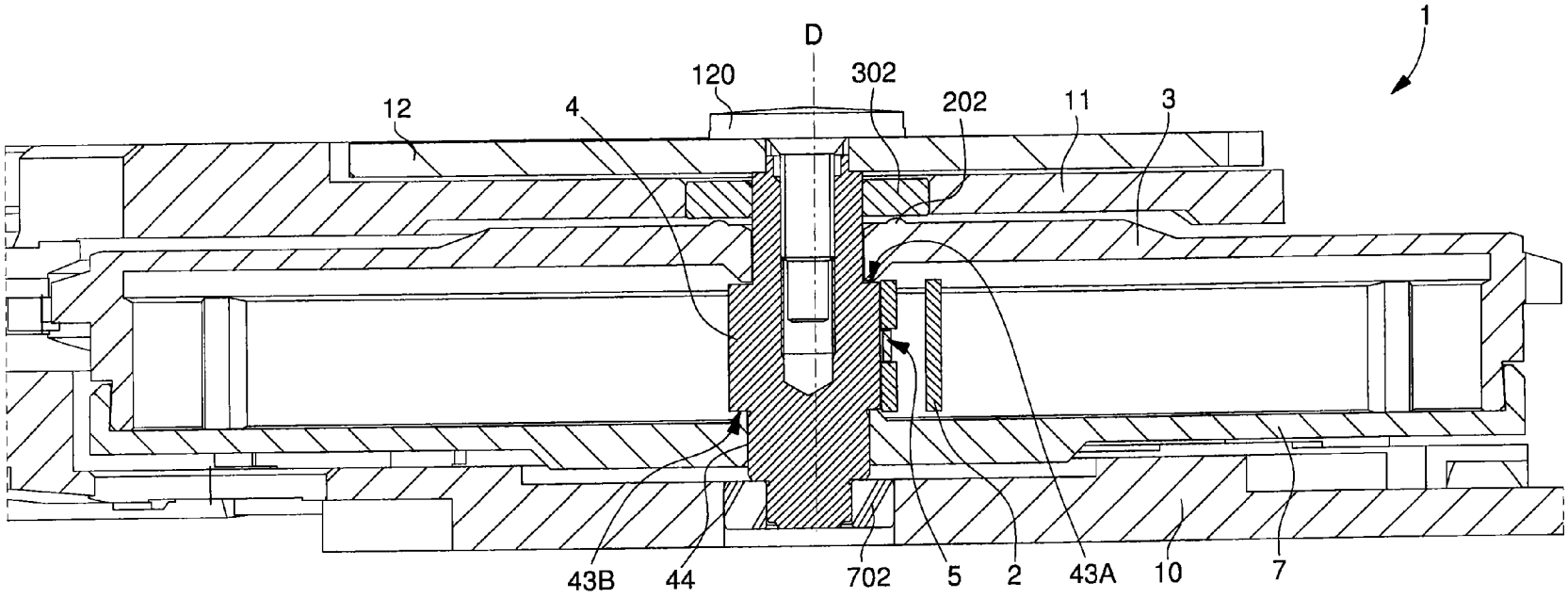
FIGS. 10 to 16 show schematic cross-sectional views of different variants of the timepiece barrel according to the invention in a plane passing through the pivot axis.

FIG. 10 illustrates an inverted configuration relative to that of FIG. 5, and it is drum 3 of FIG. 10 which carries a fillet 202, intended to cooperate in abutment with a jewel 302 driven into a bridge 11, and jewel 302, whose bore guides a shoulder 43 of the core. In this particular variant, the same cylindrical shoulder 43 extends to guide the pivoting of drum 3.

Transferring the fillet to the jewel makes it possible to control the friction torque between the fillet and the jewel, and keep it at a very low value.

In FIG. 10, the shake between the core and the assembled barrel assembly is given by the limited support of drum 3 and of cover 7 on shoulders 43A and 43B of core 4.

The shake of the barrel assembly relative to the ébauche is defined by the axial play of core 4, which is limited by fillet 202 of drum 3 opposite jewel 302.

The FIG. 10 variant is illustrated here with a bridge 11 inserted between drum 3 and ratchet 12.

Figure 11:
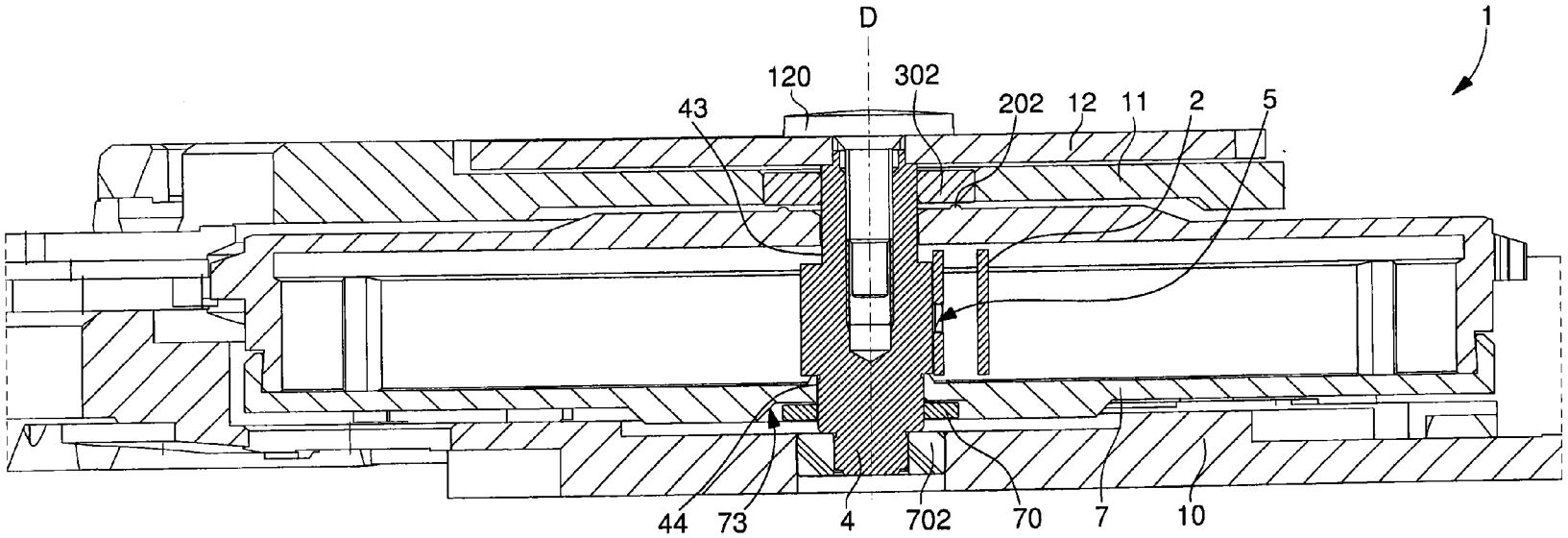

FIG. 11 also shows a fillet 202 of drum 3 arranged to cooperate with a jewel 302 driven into a bridge 11.

Core 4 carries a washer 70 driven onto one of its shoulders 44. Washer 70 is driven on high up to provide an axial space.

The shake of the core relative to the barrel assembly is limited by the clearance of washer 70 relative to a bottom bearing surface 73 of cover 7.

The shake of the barrel with respect to the ébauche is limited by core 4 relative to jewel 702 of plate 10 on the one hand, and by fillet 202 of drum 3 relative to bridge 11 on the other hand.

Figure 12:
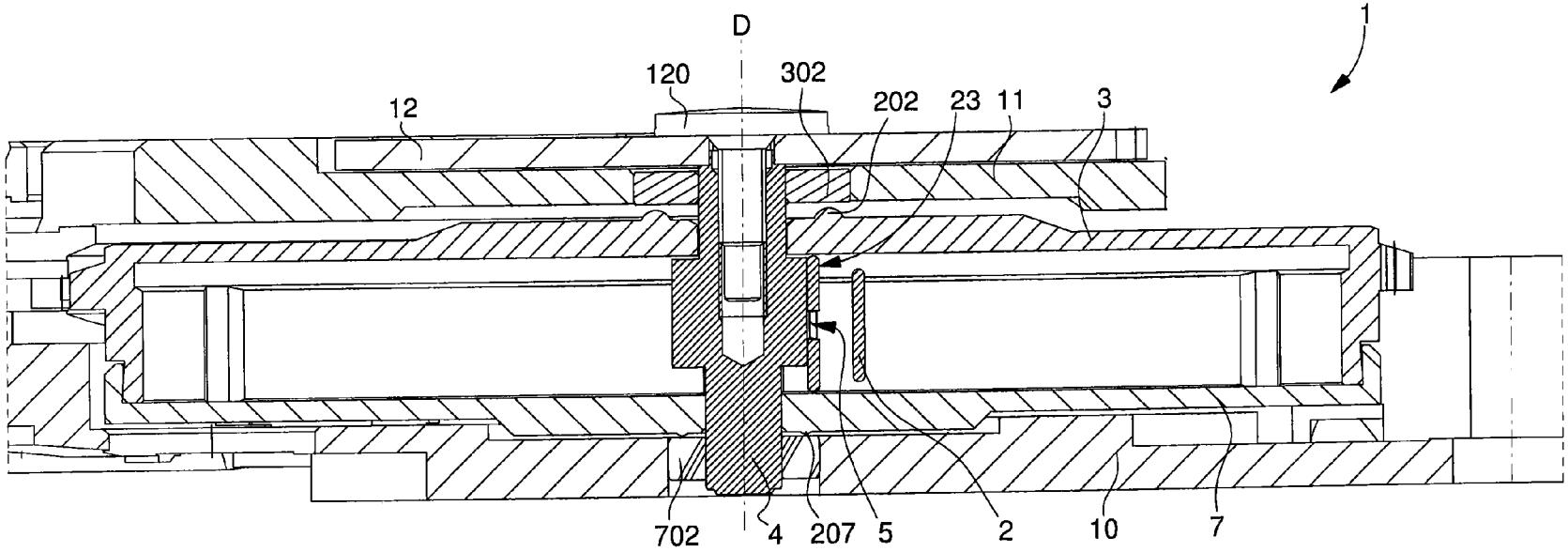

FIG. 12 also shows a fillet 202 of drum 3 arranged to cooperate with a jewel 302 driven into a bridge 11 and a fillet 207 of cover 7 arranged to cooperate with a jewel 702 driven into plate 10.

In FIG. 12, the endshake of the barrel alone is ensured by spring 2 which has a projecting area 23, represented here in the form of a first enlarged coil, directly cooperating, according to the position of core 4, with an internal surface 31 of drum 3, or with an inner surface 71 of cover 7. The shake of the barrel in the bridges is ensured by fillets 202 or 207 on each side, outside the drum and the cover.

Figure 13:
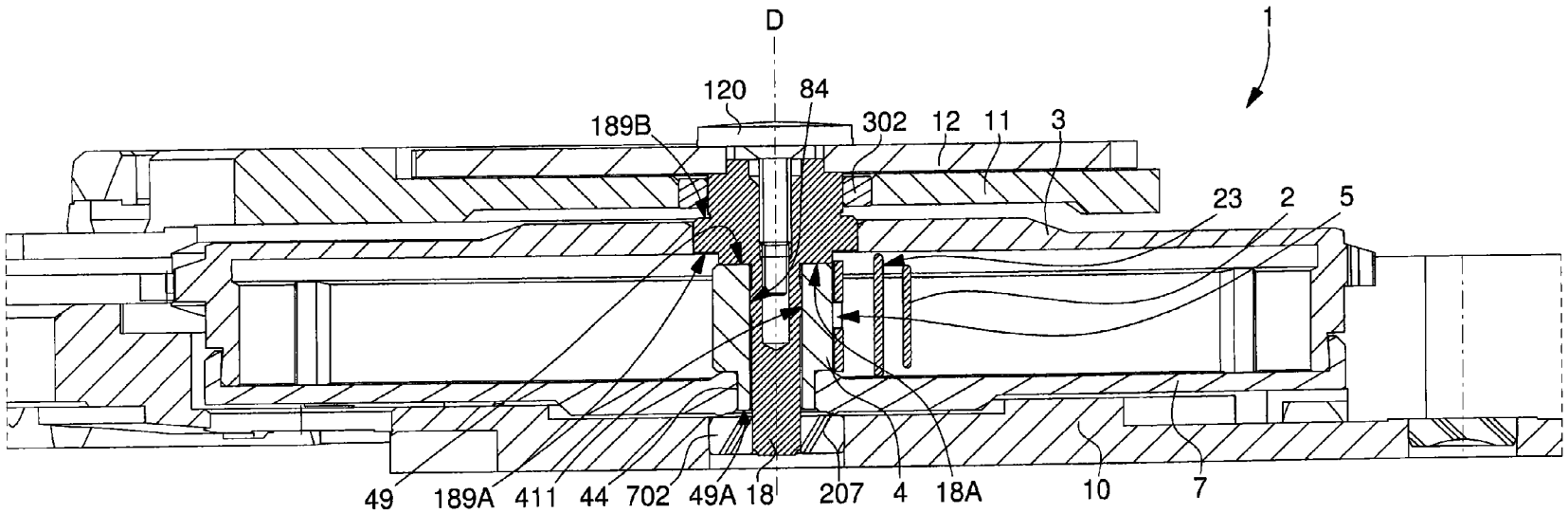

FIG. 13 shows a fillet 207 of cover 7 arranged to cooperate with a jewel 701 driven into plate 10.

The core is in two parts: the actual core 4 carrying spring 2, fitted onto a barrel arbour 18, with axial limitation via a bearing surface 18A of barrel arbour 18 and an opposite bearing face 49 of core 4.

Core 4, carrying the inner end 22 of spring 2, includes a core bore 411 cooperating with a shoulder 84 of a barrel arbour 18.

The shake of the barrel alone is taken up by spring 2, which has a projecting area 23, here an added flange or a coil sufficiently remote from the axis to bear on the inner surface 31 of drum 3 rather than on a bottom shoulder 189A of the barrel arbour.

Whereas the shake of the barrel completed by the ébauche is ensured, on the one hand by a top shoulder 189B of the barrel arbour 18 arranged to be in bearing contact with jewel 302 of bridge 11, and on the other hand by the contact of fillet 207 of cover 7 on jewel 702 of plate 10.

Figure 14:
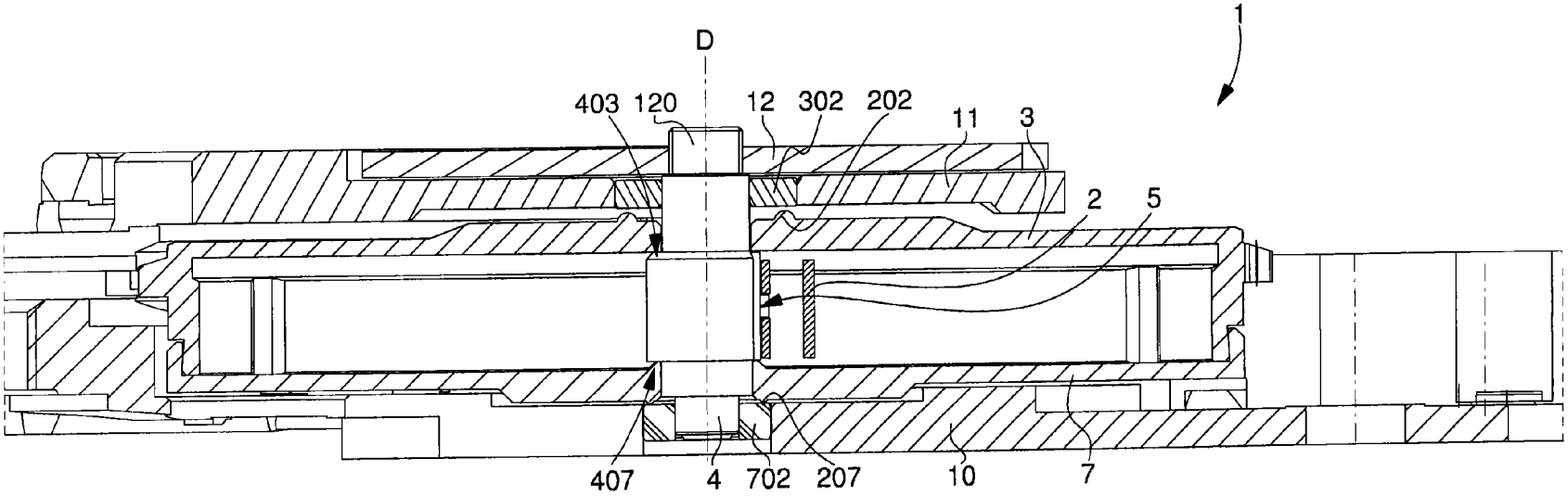

FIG. 14 also shows a fillet 202 of drum 3 arranged to cooperate with a jewel 302 driven into a bridge 11, and a fillet 207 of cover 7 arranged to cooperate with a jewel 702 driven into plate 10.

The take-up of the shake of the complete barrel in the ébauches occurs in the same way as in FIG. 12, whereas the shake of the barrel alone with regard to the ébauche is taken up by contact with a shoulder of core 4, respectively 407 with cover 7 or 403 with drum 3.

FIG. 14 shows a ratchet 12 including an inner thread screwed onto an external thread of core 4.

Figure 15:
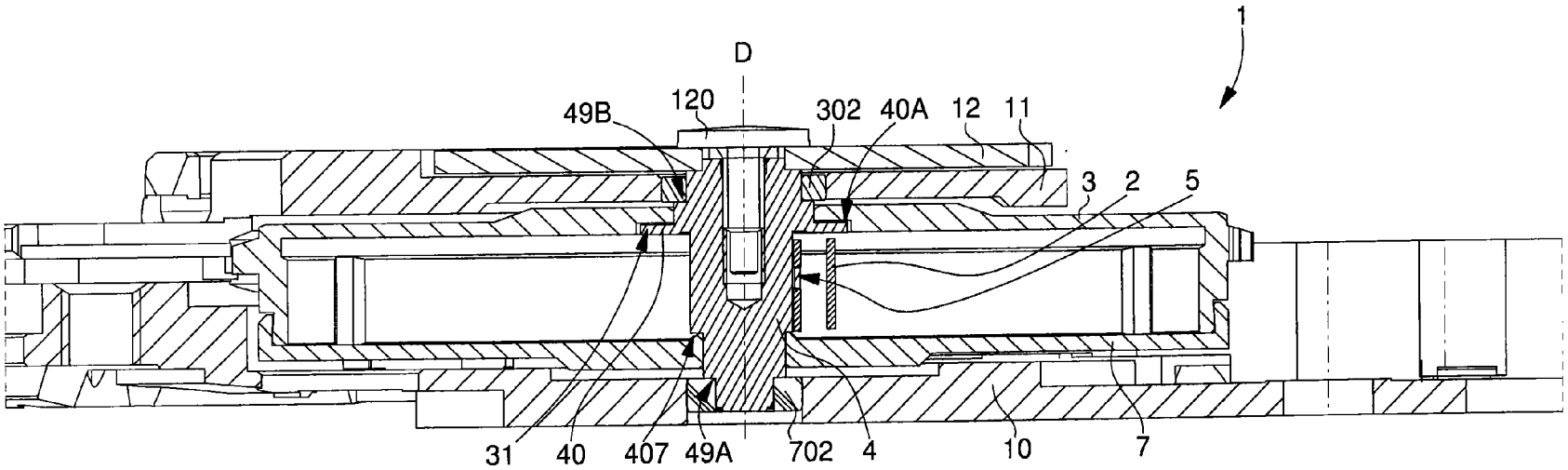

FIG. 15 illustrates an advantageous variant with a core 4 having a bottom collar 40, which is arranged to be bear, via a bearing face 401, on an inner face 31 of drum 3.

The shake of the core relative to the barrel assembly is limited by the shake of drum 3 and of cover 7 relative to bearing faces 40A and 407 of core 4.

The shake of the barrel assembly relative to the ébauche is defined by the contacts between the opposite bearing faces 49A and 49B of core 4, with jewels 702 of plate 10 and 302 of bridge 11 respectively.

Core 4 is advantageously formed in several coaxial parts to simplify machining.

FIG. 16 is a variant of the version of FIG. 14. In this version, the shakes are taken up in the same manner. However, the guide members are different since the pivoting of the drum 3 and cover 7 occurs directly in the ébauche, respectively in bridge 11 and plate 10. This arrangement provides better control of axial play, due to the enlarged pivoting diameter.

The invention also concerns a timepiece 1000 including at least one timepiece movement 100 and/or at least one barrel assembly 1 for energy storage with one input formed either by a ratchet 12 mounted for integral rotation with core 4, or by a drum toothing 13 mounted for integral rotation with drum 3, and an output formed respectively either by a drum toothing 13 mounted for integral rotation with drum 3, or by a ratchet 12 mounted for integral rotation with core 4.

The invention provides the means of forming a core of very small diameter, and thus of increasing the storage capacity and power reserve of a movement mechanism or striking mechanism or similar mechanism.

It is important to control shakes in order to limit the wear of components and increase the reliability of mechanisms.

The invention claimed is:

1. A timepiece movement comprising:

at least one plate at a fixed distance of centers from a bridge jointly carrying a timepiece barrel assembly including at least one barrel spring mounted between, at a first end, a barrel drum arranged beside the bridge, and at a second end, a receiving surface comprised in a steel or stainless steel barrel core rotating integrally with a ratchet and coaxial to the drum about a common pivot axis, the barrel assembly including on the plate side a cover fixed to the drum, the cover and the drum together forming a chamber confining the spring, wherein the spring is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shear modulus of between 80 and 100 GPa, and having a width to thickness ratio of between 9 and 21, wherein a maximum radius of the steel or stainless steel core relative to the pivot axis is less than nine times a maximum thickness of the spring, wherein the movement further comprises a shake limiting mechanism including at least one shim-washer, which is independent of the core and guided by a shoulder of the core and inserted between the plate or the bridge respectively and the cover or the drum respectively, wherein the drum pivots in the bridge or in a guide member carried by the bridge, and includes an axial support shoulder configured to cooperate to limit an end of travel of the drum with a complementary stop surface of the bridge or of the guide member, and the cover pivots in the plate or in a guide member carried by the plate, and includes an axial support shoulder configured to cooperate to limit an end of travel of the cover with a complementary, stop surface of the plate or of the guide member, wherein the core includes a first shoulder pivoting in a bore in the drum, and a second shoulder pivoting in a bore in the cover, and wherein a relative endshake between the core and the drum is limited by a first stop surface of the core and a first complementary internal stop surface of the drum, and a relative endshake between the core and the cover is limited by a second stop surface of the core and a second complementary internal surface of the cover.

2. The movement according to claim 1, wherein the at least one shim-washer is driven onto the shoulder.

3. The movement according to claim 1, wherein the shake limiting mechanism includes a first shim-washer inserted between the bridge and the drum and a second shim-washer inserted between the plate and the cover.

4. The timepiece movement according to claim 1, wherein the shim-washer is independent of a barrel arbour carrying the core or merged therewith and of the cover, and is inserted between the plate and the cover.

5. The timepiece movement according to claim 1, wherein the core is pivoted directly in the plate and the bridge.

6. The timepiece movement according to claim 1, wherein the core is pivoted between the cover and the drum, the cover being pivoted in the plate, and the drum being pivoted in the bridge.

7. The timepiece movement according to claim 1, wherein the core includes first and second coaxial parts, the first part is pivoted directly in the bridge and includes a guide shoulder for a bore of the drum, and the second part is pivoted directly in the plate and carries a hook to hook the spring.

8. The timepiece movement according to claim 1, wherein at least one of the axial support shoulder of the drum and the axial support shoulder of the cover is formed by a fillet to reduce a contact surface.

9. The movement according to claim 8, wherein the fillet is supported on a guide member carried by the bridge or the plate.

10. The timepiece movement according to claim 1, wherein the barrel assembly includes a mechanism to limit an endshake between the barrel assembly and at least the plate or the bridge.

11. The timepiece movement according to claim 10, wherein the mechanism to limit the endshake includes a guide to guide pivoting of the drum and the cover directly in at least one of the plate and the bridge.

12. The timepiece movement according to claim 10, wherein the mechanism to limit the endshake includes a shim or a mechanism to limit travel of at least one of the drum and the cover relative to at least one of the plate and the bridge.

13. The timepiece movement according to claim 10, wherein the mechanism to limit the endshake includes at least one of at least one lip protruding from an external surface of the drum opposite the plate or the bridge and at least one lip protruding from an external surface of the plate or of the bridge and facing an external surface of the drum.

14. The timepiece movement according to claim 13, wherein the mechanism to limit the endshake is supplemented by at least one of at least one lip protruding from an external surface of the ratchet carried by the core opposite the plate or the bridge and at least one lip protruding from an external surface of the plate or of the bridge and facing an external surface of the ratchet.

15. The timepiece movement according to claim 10, wherein the mechanism to limit the endshake includes at least one of at least one lip protruding from an external surface of the cover opposite the plate or the bridge and at least one lip protruding from an external surface of the plate or of the bridge and facing an external surface of the cover.

16. The timepiece movement according to claim 1, wherein the receiving surface is a surface of revolution relative to the pivot axis.

17. The timepiece movement according to claim 1, wherein the spring is fixed by friction to the core.

18. The timepiece movement according to claim 1, wherein the spring forms, with the core, a welded or soldered single-piece spring-core sub-assembly.

19. A timepiece comprising at least one timepiece movement according to claim 1 to store energy with one input formed either by the ratchet mounted for integral rotation with the core, or by a drum toothing mounted for integral rotation with the drum, and an output respectively formed either by a drum toothing mounted for integral rotation with the drum, or by the ratchet mounted for integral rotation with the core.

* * * * *